United States Patent [19]

Panuline

[11] 3,951,574

[45] Apr. 20, 1976

[54] RECIPROCATING PLUNGER TYPE PUMP WITH STROKE ADJUSTMENT MEANS

[75] Inventor: George Panuline, Richmond, Va.

[73] Assignee: D-Cycle Power Systems, Inc., Richmond, Va.

[22] Filed: Sept. 6, 1974

[21] Appl. No.: 503,929

[52] U.S. Cl. ..... 417/510; 92/13.7

[51] Int. Cl.[2] ..... F04B 7/00; F15B 15/24

[58] Field of Search ..... 417/510; 92/13.7, 13.3

[56] References Cited

UNITED STATES PATENTS

| | | | |
|---|---|---|---|
| 1,601,345 | 9/1926 | Burtnett | 417/510 |
| 2,066,860 | 1/1937 | Shumake | 92/13.7 X |
| 2,147,989 | 2/1939 | Puurmann | 92/13.7 X |

FOREIGN PATENTS OR APPLICATIONS

| | | | |
|---|---|---|---|
| 911,452 | 4/1954 | Germany | 92/13.7 |

*Primary Examiner*—William L. Freeh
*Assistant Examiner*—Thomas I. Ross
*Attorney, Agent, or Firm*—Harold L. Stowell

[57] ABSTRACT

A high pressure, positive displacement, reciprocating plunger type pump is provided having mechanism for infinitely variable stroke adjustment and simple fluid flow. The pump may also include a poppet type feeder valve mechanism operatable from the same drive mechanism as reciprocates the pump plunger.

2 Claims, 7 Drawing Figures

RECIPROCATING PLUNGER TYPE PUMP WITH STROKE ADJUSTMENT MEANS

The present invention relates to an improved pump assembly of the positive displacement, high pressure type with means for infinitely varying the output volume over a substantial fluid flow range.

It is a particular object of the present invention to provide such a pump that is relatively simple in construction and requires low torque and power.

It is a further object of the invention to provide such a pump having simple fluid flow paths and volume flow control means suited for either manual or automatic actuation.

It is another object of the present invention to provide simple fluid feed means for a variable stroke, reciprocating, high pressure pump wherein the feed means includes positive means for preventing reverse flow of the fluid during the pressure cycle of the high pressure pump.

Other objects and advantages of the present invention will be apparent to those skilled in the art from the following detailed description and the drawing.

In general, the invention may be defined as consisting of a positive displacement fluid pump having a pump housing; a cylinder in the housing having fluid inlet and outlet passages communicating with one end thereof; a pump plunger mounted for reciprocation in the cylinder; drive means for reciprocating the plunger wherein the drive means includes a lever arm having engagement at one end with the plunger and engagement at the other end with lever arm rocking means; a fulcrum for the lever arm and means for moving the fulcrum to vary the travel distance of the plunger; and further, the invention may also include feed means for the pump plunger cylinder comprising a feed chamber in the housing; a valve seat in the chamber dividing the chamber into an inlet zone and an outlet zone; means connecting the inlet zone with a source of fluid and the outlet zone with the inlet to the plunger cylinder a poppet valve reciprocatably mounted in the feed chamber between the inlet and outlet zones; and means for reciprocating the poppet valve in a predetermined phased relationship with the means for reciprocating the plunger.

The invention will be more particularly described in reference to the accompanying drawing wherein.

Figure 1:
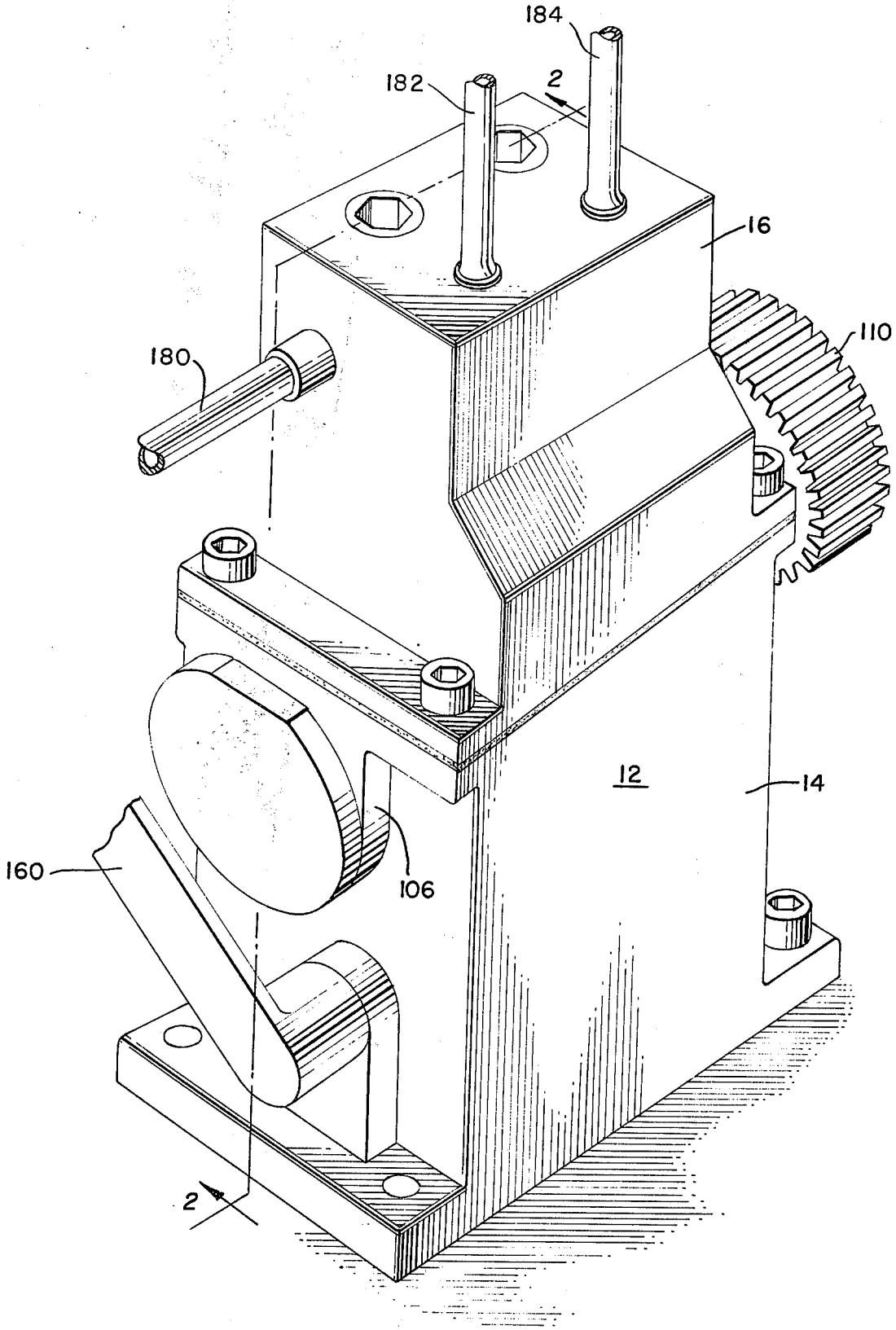
FIG. 1 is a perspective view of a pump embodying the features of the present invention.

Referring to the drawing, 10 generally designates a dual form of an improved high pressure, variable volume, positive displacement pump embodying the principles of the invention. The pump 10 includes housing 12 which is divided into two parts; a lower part 14 and an upper part 16 with the actuating and control mechanisms for the pump being housed in the lower portion 14 and the pump proper and its feed mechanism being housed in the upper portion 16.

Figure 2:
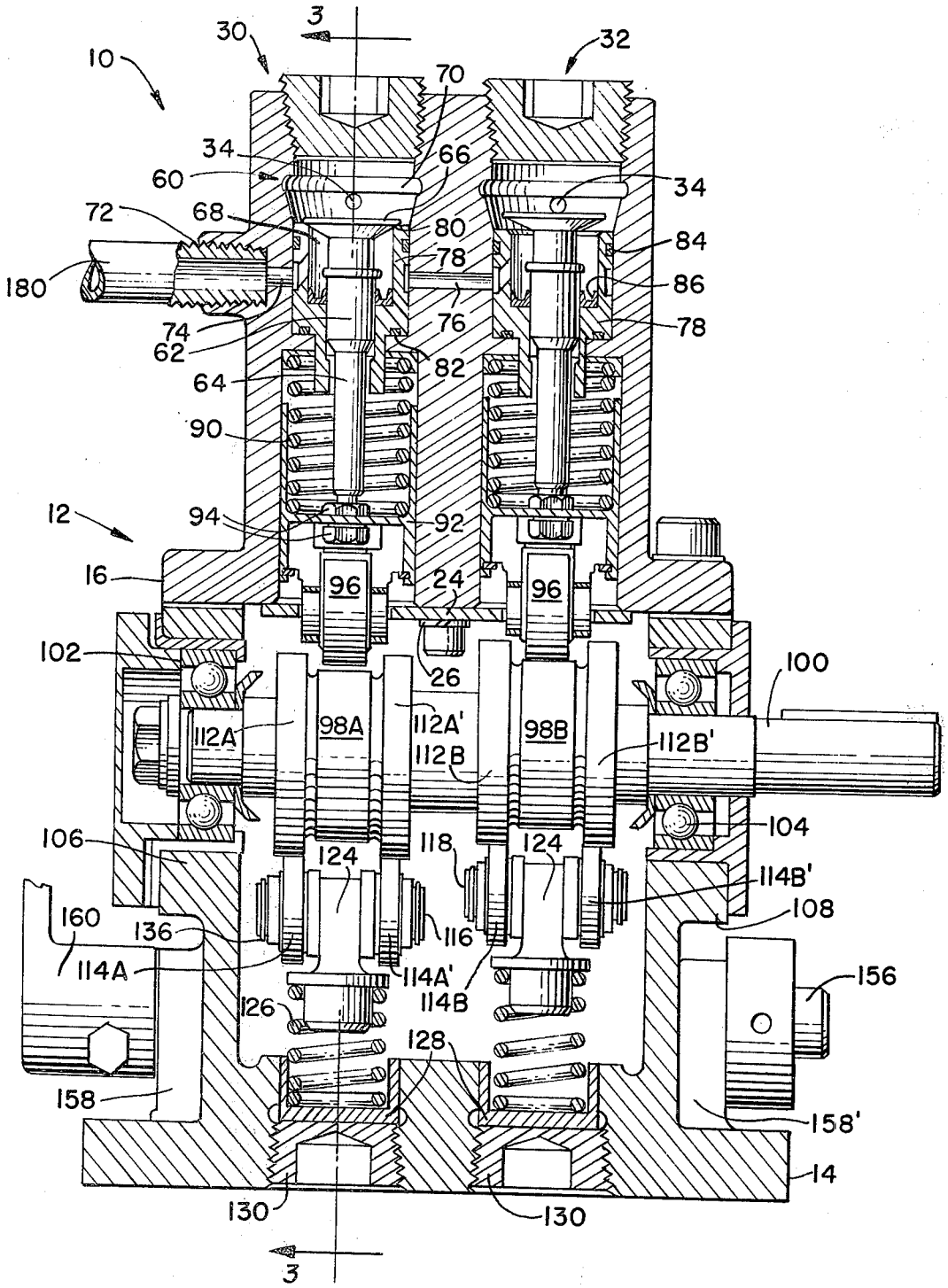
FIG. 2 is a section substantially on line 2—2 of FIG. 1.

The upper portion 16 of the housing 12 is provided with a pair of identical parallel side-by-side bores 18 forming cylinders for a pair of side-by-side pump plungers 20. The lower portions of each of the bores 18 are enlarged and receive plunger guide elements 22 which are retained in the respective bores by a retainer guide 24 and lock washers and bolts 26, FIG. 2 of the drawing. A seal between each of the reciprocating plungers 20, their bores 18 and their retainers 22 is provided by a generally toroidal shaped, U-formed sealing member 28 having its inner leg engaging the cylindrical surface of its plunger 20 and the outer rims or legs engaging the bore of its plunger cylinder. Pressure of the fluid, created by the reciprocating plunger 20, forces legs of each of the pair of sealing elements into tight engagement with their respective parts and as the pressure of the fluid being pumped increases, the sealing forces likewise increase providing a very simple but highly effective seal for the pump chambers thereby permitting the utilization of normal machining tolerances in the manufacture of the pump's plungers and cylinders.

The upper end of each of the bores 18, forming the plunger cylinders, is connected to a feed mechanism consisting of feed elements 30 for one of the plungers and 32 for the other via the pair of internal passages 34. Further, the upper end of each of the plunger cylinders is connected to means utilizing the pumped fluid via the pair of internal conduits 36, each having an outlet fitting 38.

Figure 4:
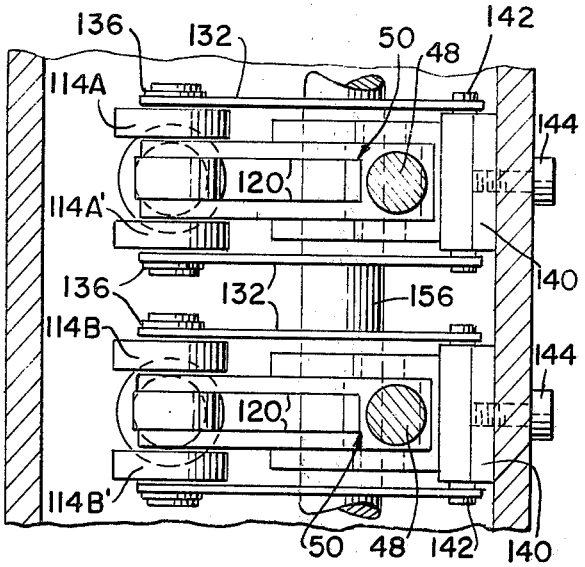
FIG. 4 is a section on line 4—4 of FIG. 3.

The lower end of each of the plungers 20 is provided with an enlarged fitting 40, the upper surface of each of which forms a seat for the lower end of one of the pair of helical springs 42, the upper ends of which bear against their respective plunger guides as at 44. The under surface of each of the fitments 40 is flat to receive a segment of a ball 46, a portion of which is received in a generally hemispherical bore 48 in ends 52 of the pair of plunger actuating levers 50, FIG. 4, as to be more fully described hereinafter.

As hereinbefore set forth, each of the pair of plunger cylinders is independently fed by feed mechanisms 30 and 32. But for timing of the opening and closing of the feed mechanism, they are identical and in general only feed mechanism 30 will be described, in particular reference to FIGS. 2 and 3 of the drawing.

Each feed mechanism includes a feed chamber 60 within which is mounted a poppet type valve 62 with the stem portion 64 projecting downwardly and the valve face portion 66 dividing the feed chamber 60 into an inlet zone 68 and an outlet zone 70. Feed devices 30 and 32 are fed from a common inlet port 72 and internal passages 74 and 76. Each of the valve chambers is also fitted with a guide sleeve 78, the upper surface 80 of which forms a seat for the valve 62. The valve guide elements 78 are sealed in their respective bores by suitable O-rings such as illustrated at 82 and 84 and the stem portion of each of the poppet valves is further sealed from the operating mechanism by U-shaped sealing elements 86 similar in construction and function to the sealing elements 28 for the plungers 20 of the pumps per se.

Each of the poppet valves 62 is urged into seating relation with its respective seat by helical springs 90, spring guides 92 and lock nuts 94. The lower portion of the spring guides 92 are positioned by retainer guide 24 and have means for rotatably mounting thereon cam followers or rollers 96 and each of the cam rollers 96 is positioned in operative relationship to its respective cams 98A and 98B. The cams 98A and 98B are keyed to cam shaft 100 mounted, in antifriction bearing means 102 and 104, suitably mounted in side walls 106 and 108 of the lower housing 14. The projecting portion of the shaft 100 has keyed thereto a toothed wheel 110 suitably connected to drive means for the pump not shown.

Figure 5:
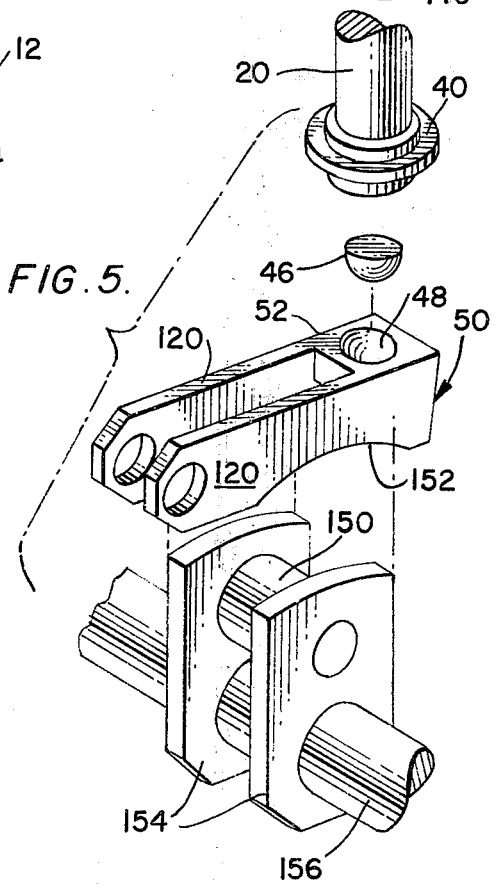
FIG. 5 is an enlarged exploded view of the means for varying the stroke of the high pressure plunger of the pump mechanism.
Figure 6:
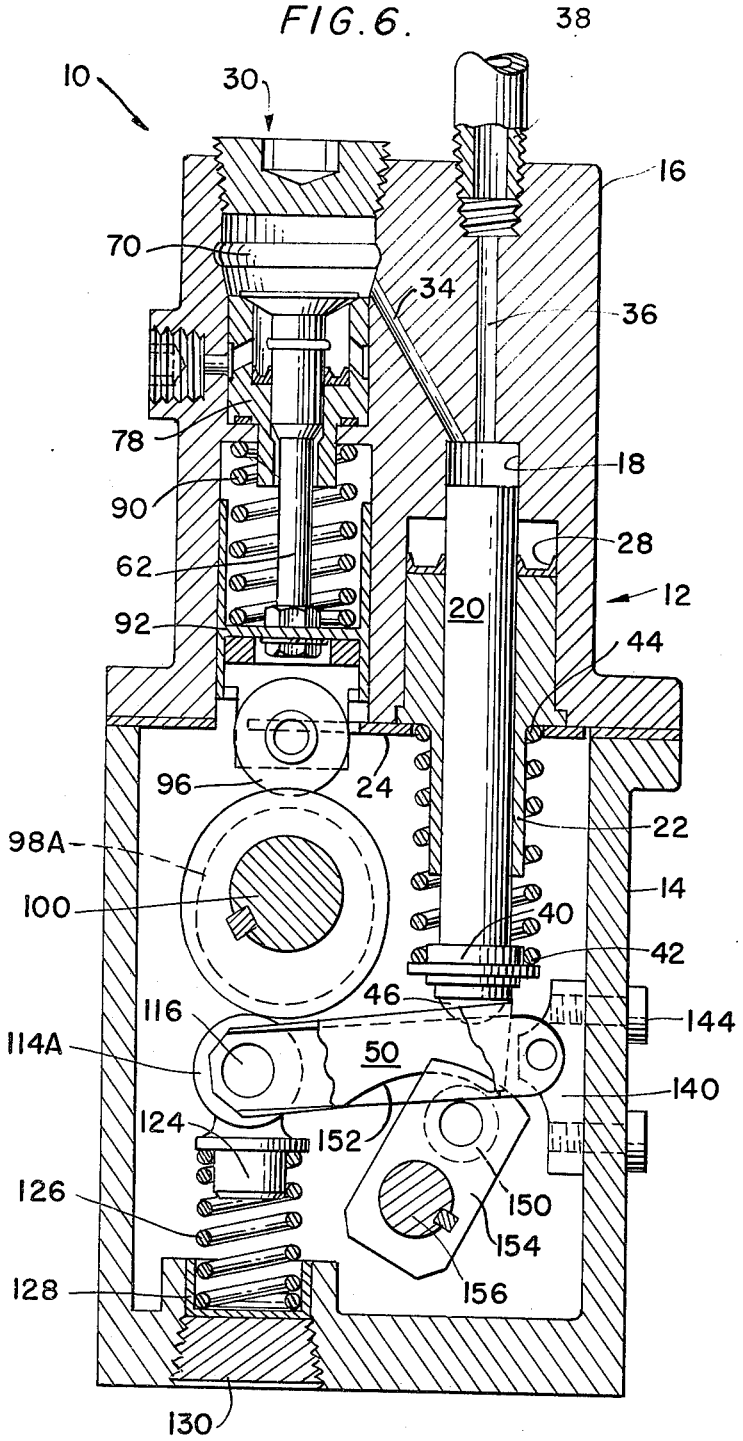
FIG. 6 is a view similar to that shown in FIG. 3 with the adjusting mechanism in the minimum flow position.
Figure 7:
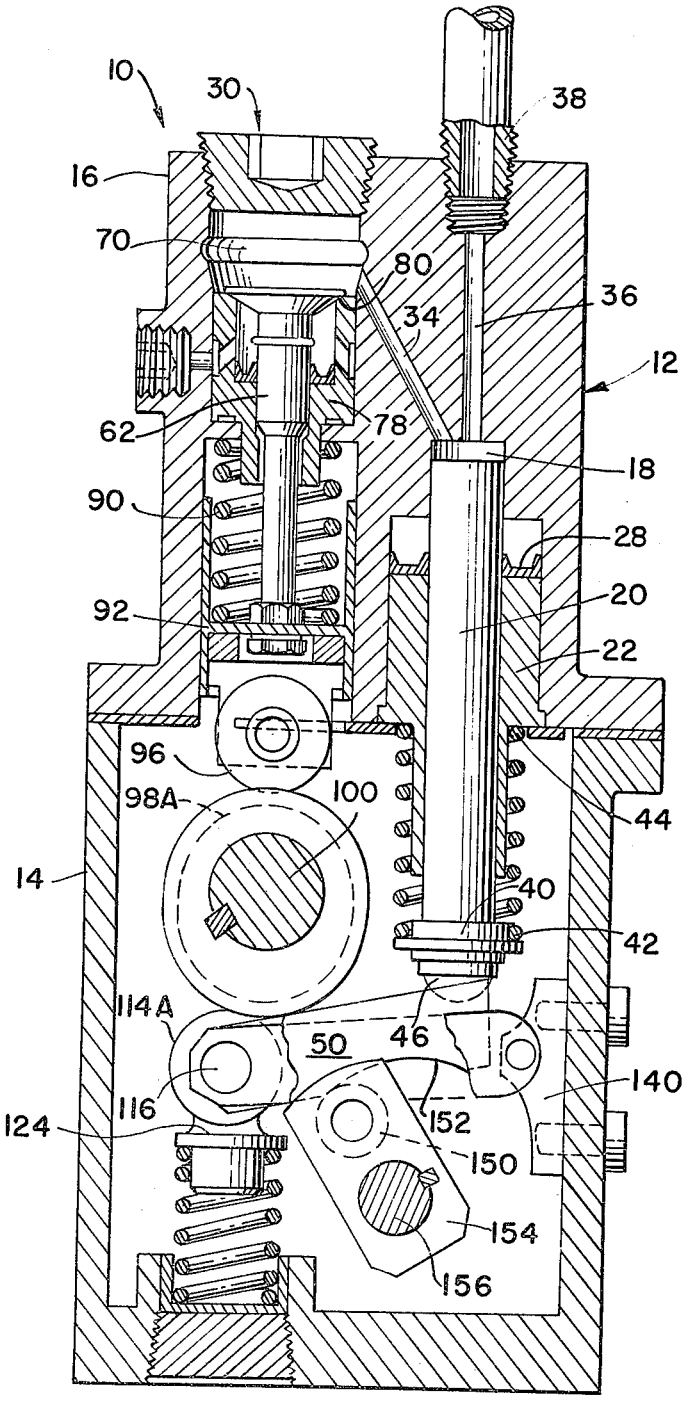
FIG. 7 is a view like FIG. 6 with the adjusting mechanism in the maximum flow position.

Each of the cams having the cams surfaces 98A and 98B also includes spaced cam surfaces 112A, 112A', 112B and 112B' respectively. Each of these cam surfaces 112A, A', B, and B' may be of similar configuration to the cam surfaces 98A and 98B as more clearly shown in FIG. 2 of the drawing and such surfaces engage spaced cam rollers 114A, 114A', 114B and 114B' respectively. The pair of cam rollers 114A and A' are mounted for rotation on a common shaft 116 and cam rollers 114B and B' are mounted on a common shaft 118. The shafts pass through paired arms 120 and 132 of their respective levers generally designated 50 as more clearly shown in, for example, FIGS. 2, 4 and 5.

Further, each of the shafts 116 and 118 passes through upper spring seat members 124 engagable by the upper ends of helical springs 126. The lower ends of springs 126 are engaged in lower spring seat members 128 retained in bores in the lower end of the lower housing 14 by threaded retainers 130. The springs 126 maintain their respective cam rollers in engagement with the cam surfaces 112A, A', B and B'. Further, as more clearly shown in FIG. 4, the cam rollers, their supporting shafts, etc. are maintained in the desired position within the lower portion of the pump housing by paired, spaced link members 132 having ends 134 bored to receive shafts 116 and 118 respectively and retained thereon by suitable snap rings such as illustrated at 136.

The other end of each of the pair of links 132 is pivotally pinned to hinge elements 140 via hinge pins 142. The hinge elements 140 are secured by studs 144 to the inner wall of the lower pump housing 14, again as more clearly shown in FIGS. 3 and 4. Thus, each of the cam roller pins connected to the ends of the legs 120 of each lever arm 52 is caused to generally reciprocate or pivot about a line of contact between the cylindrical surface of fulcrum 150 and the curvilinear surfaces 152 formed in the lever members 52.

Figure 3:
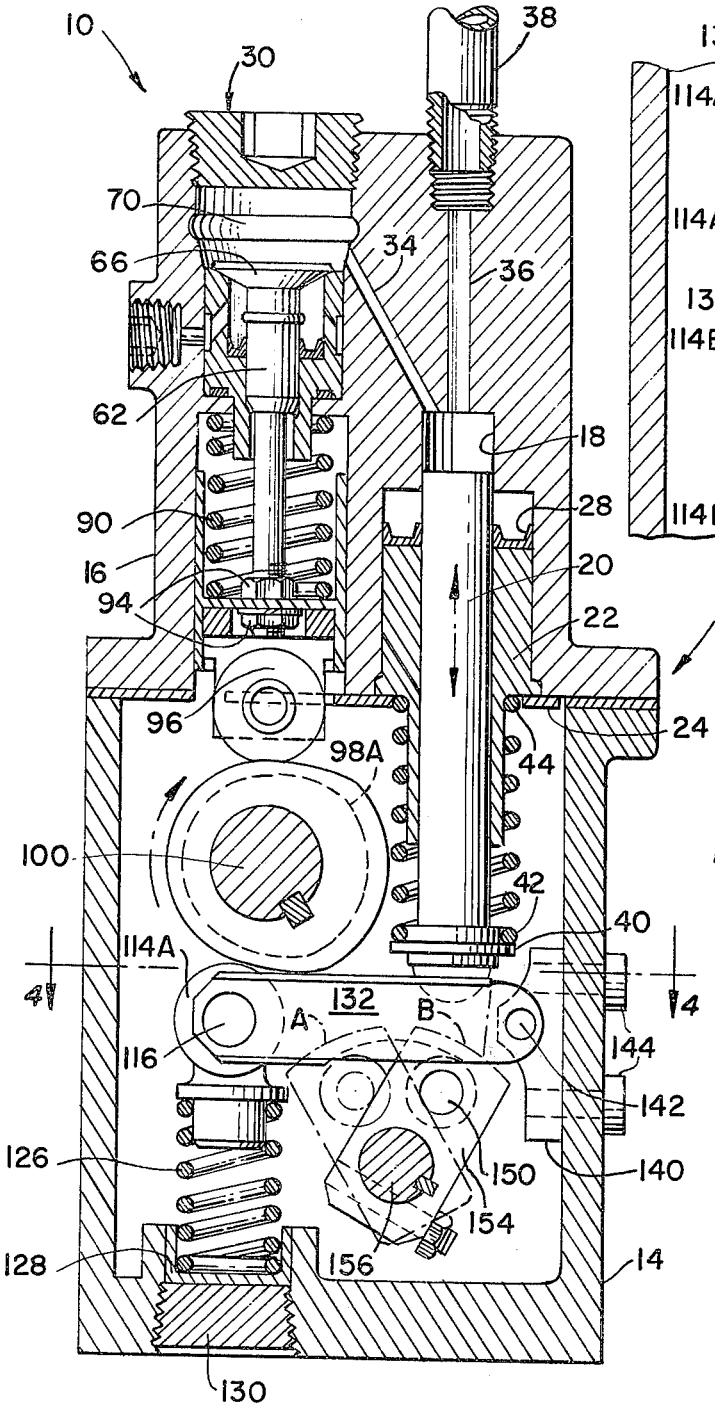
FIG. 3 is a section on line 3—3 of FIG. 2.

Each of the cylindrical fulcrum members 150 is mounted via a pair of arm members 154 keyed to shaft 156, which shaft is mounted for rotation via bearings 158 and 158' in the lower end of the lower casing 14 of housing 12, whereby upon rotation of shaft 156, within the limits illustrated in FIG. 3, the fulcrum of each of the lever arms 52 is varied from zone A to zone B comprising the maximum and minimum pumping conditions for the illustrated pump. When the line of contact between the curvilinear surfaces 152 of levers 52 and the members 150 are in the B position, that is substantially vertically below the center of the plungers 20, no rocking motion is imparted to the plungers upon movement of the levers 52 by cam surfaces 112A, A', B and B'.

The extended end of shaft 156 has secured thereto a lever 160 which is externally connected to manual or automatic means for varying the stroke of each of the plungers 20.

OPERATION OF THE IMPROVED PUMP

The improved variable volume pump of the invention may be employed wherever an accurate and variable high pressure pump is required and the invention has substantial utility as a vaporizable liquid injector pump for external power producing systems such as disclosed in U.S. Pat. Nos. 3,584,457; 3,772,883; and 3,716,990. However, for purposes of illustration, the pump will be described as a fuel injection pump for a two cylinder internal combustion engine. In operation, the inlet port 72 for the pair of feeders 30 and 32 is connected to a conduit 180 connected to a source of combustible fuel via a low pressure fuel pump and each of the outlet nipples 38 of the pump is connected via high pressure conduits 182 and 184 to the cylinder spaces of the internal combustion engine while drive wheel 110 for shaft 100 is connected via conventional timing gears to the crank shaft of the engine. Volume control lever 160, externally mounted to shaft 156, for varying the position of the fulcrums 150 is connected to, for example, the foot operated speed control pedal for the engine. With the feed poppet valves 30 and 32 in the positions shown in FIG. 2, e.g. with feeder poppet valve 30 in the closed position and feeder poppet valve 62 in the open position, fuel entering port 72 flows via passage 76 about the open port of valve 62 through passage 34, FIG. 3, into the plunger cavity or cylinder space 18 of its associated variable volume, high pressure pump. When the cam 98B moves from the FIG. 2 position to the position corresponding to the position of cam 98A, FIG. 2, the spring 90 closes the poppet valve and at the same time, the cam lobes 112B and B' urge end 52 of lever member 50 downwardly rocking the opposite end of the lever arm carrying the segment of the ball 46 upwardly to force the piston 20 into the cylinder space 18 forcing the liquid contained therein or a portion thereof governed by the position of the fulcrum surface 150 relative to the arc 152. At the same time that the poppet valve of feeder mechanism 32 is closing, poppet valve 30 is opening as cams 98A and 98B are 180° out of phase with each other so that fuel then flows to the cylinder space of the other variable volume plunger. The amount of fuel fed into the cylinder space of the fuel injected engine is controlled by rotation of the control lever 160 as hereinbefore set forth, in response to the power requirements of the engine from idle to maximum output.

From the foregoing description, it will be seen that the present invention fully accomplishes the aims and objects hereinbefore set forth. Further, it will be recognized that various modifications may be made in the high pressure, variable volume pump and the illustrated examples are by way of example and not by way of limitation.

I claim:

1. A positive displacement fluid pump including a pump housing; a cylinder in said housing having fluid inlet and outlet passages communicating with one end of said cylinder; a pump plunger mounted for reciprocation in the cylinder; drive means for reciprocating said plunger comprising; a lever arm; means at one end of said plunger having engagement with one end of said lever arm; means at the other end of the lever arm having engagement with lever arm rocking means; a fulcrum for said lever arm and means for moving the fulcrum to vary the travel distance of the plunger; feed means for the pump plunger cylinder comprising a feed chamber in said housing; a valve seat in said chamber dividing said chamber into an inlet zone and an outlet zone; means connecting the inlet zone with a source of fluid and said outlet zone with the inlet to said cylinder; a poppet valve reciprocatably mounted in said feed chamber between the inlet and outlet zones; and means for reciprocating the poppet valve in a predetermined phase relation with the means for reciprocating the plunger; wherein the means for rocking the lever arm and for reciprocating the poppet valve comprises a cam and cam followers; wherein the fulcrum for the lever arm comprises a cylindrical member, means mounting said cylindrical member from a lever arm and means for moving said lever arm to swing the cylindrical surface of the fulcrum in an arcuate path in contact with an arcuate track on said lever arm; and wherein the means at one end of the plunger which engages the lever arm is a segment of spherical bearing element.

2. The invention defined in claim 1 wherein the spherical bearing element is maintained in contact with said one end of the lever arm by a helical spring acting between the pump housing and the lower end of the plunger.

* * * * *